US009404649B2

(12) United States Patent
Ashton et al.

(10) Patent No.: US 9,404,649 B2
(45) Date of Patent: Aug. 2, 2016

(54) ELECTRIC STEAM GENERATION

(75) Inventors: Steven Anthony Ashton, Isle of Man (GB); Colin Moughton, Isle of Man (GB); Nicholas Edward Gibbs, Isle of Man (GB)

(73) Assignee: Strix Limited, Ronaldsway (IM)

( * ) Notice: Subject to any disclaimer, the term of this patent is extended or adjusted under 35 U.S.C. 154(b) by 449 days.

(21) Appl. No.: 13/879,583

(22) PCT Filed: Oct. 14, 2011

(86) PCT No.: PCT/GB2011/051995
§ 371 (c)(1),
(2), (4) Date: Jul. 1, 2013

(87) PCT Pub. No.: WO2012/049517
PCT Pub. Date: Apr. 19, 2012

(65) Prior Publication Data
US 2013/0279890 A1 Oct. 24, 2013

(30) Foreign Application Priority Data
Oct. 15, 2010 (GB) ..... 1017461.3

(51) Int. Cl.
*F22B 1/28* (2006.01)
*F24H 1/18* (2006.01)

(52) U.S. Cl.
CPC ..... *F22B 1/285* (2013.01)

(58) Field of Classification Search
None
See application file for complete search history.

(56) References Cited

U.S. PATENT DOCUMENTS

| | | | | | |
|---|---|---|---|---|---|
| 734,871 | A * | 7/1903 | Hopwood | F22B 3/04 | 122/40 |
| 809,839 | A * | 1/1906 | Payne | F22B 1/287 | 122/4 A |
| 1,136,845 | A * | 4/1915 | Tate | F02M 1/00 | 123/549 |
| 2,097,582 | A * | 11/1937 | Beyrodt | F22B 1/28 | 392/396 |
| 3,419,666 | A * | 12/1968 | Groom | F22B 1/287 | 373/109 |
| 3,508,354 | A * | 4/1970 | McCracken | D06F 75/12 | 38/77.6 |
| 3,683,153 | A * | 8/1972 | Heyer | F25D 21/14 | 219/439 |
| 3,781,519 | A * | 12/1973 | Martin | A45D 19/16 | 392/404 |
| 3,806,102 | A * | 4/1974 | Valenta | A61M 16/16 | 128/200.13 |
| 3,864,440 | A * | 2/1975 | Giocoechea | A61M 16/16 | 128/200.13 |
| 3,982,095 | A * | 9/1976 | Robinson | A61M 16/162 | 128/200.11 |

(Continued)

FOREIGN PATENT DOCUMENTS

| | | |
|---|---|---|
| CN | 101818890 | 9/2010 |
| DE | 19607658 | 9/1997 |

(Continued)

*Primary Examiner* — Thor Campbell
(74) *Attorney, Agent, or Firm* — O'Shea Getz P.C.

(57) ABSTRACT

A pressurized boiler (1) for a steam generator appliance comprises an evaporation chamber (78), an electric heater (60) in good thermal contact with a wall (70) of the evaporation chamber (78), a water inlet (77) arranged in a cover (72) of the evaporation chamber (78) separate from said wall (70), and a pump in fluid communication with the water inlet (77) arranged to supply water to the evaporation chamber (78) through the water inlet (77).

16 Claims, 4 Drawing Sheets

(56) References Cited

U.S. PATENT DOCUMENTS

| | | | | |
|---|---|---|---|---|
| 4,377,737 | A * | 3/1983 | Berry | F22B 1/284 122/33 |
| 4,516,011 | A * | 5/1985 | Jeffress | A45D 4/16 132/229 |
| 4,578,563 | A * | 3/1986 | Eguchi | A45D 19/16 392/396 |
| 4,724,824 | A * | 2/1988 | McCoy | A21B 1/24 122/39 |
| 6,228,175 | B1 * | 5/2001 | Ridgeway | C23C 16/4481 118/726 |
| 6,243,535 | B1 | 6/2001 | Bochud | |
| 7,476,369 | B2 * | 1/2009 | Yin | A61L 2/07 392/399 |
| 7,577,343 | B2 * | 8/2009 | Chiang | F22B 1/284 122/40 |
| 7,801,424 | B2 * | 9/2010 | Cheung | A61H 33/063 392/385 |
| 8,554,063 | B2 * | 10/2013 | Hsu | F22B 1/28 122/40 |
| 2006/0108433 | A1 | 5/2006 | Fossati et al. | |
| 2010/0001484 | A1 | 1/2010 | Tay et al. | |
| 2010/0107886 | A1 | 5/2010 | Xiao et al. | |
| 2012/0039586 | A1 * | 2/2012 | Collinson | D06F 75/12 392/400 |
| 2012/0060396 | A1 | 3/2012 | Gibbs et al. | |

FOREIGN PATENT DOCUMENTS

| | | |
|---|---|---|
| EP | 0843039 | 5/1998 |
| EP | 1486725 | 12/2004 |
| GB | 2403528 | 1/2005 |
| WO | 9917056 | 4/1999 |
| WO | 0011412 | 3/2000 |
| WO | 2005024298 | 3/2005 |

* cited by examiner

ELECTRIC STEAM GENERATION

This application is entitled to the benefit of, and incorporates by reference essential subject matter disclosed in PCT Application No. PCT/GB2011/051995 filed on Oct. 14, 2011, which claims priority to Great Britain Application No. 1017461.3 filed Oct. 15, 2010.

BACKGROUND OF THE INVENTION

1. Technical Field

This invention relates to the electric generation of steam for use in domestic irons, steam cleaners, wallpaper strippers and other hand-held steam generating appliances and to various related components.

2. Background Information

Domestic steam irons have been around for a long time. They comprise a sole plate which is flat and intended to contact the item to be ironed and which is normally heated by means of a sheathed electrical resistance heater mounted to or embedded in the upper side of the sole plate. Traditionally, such irons which are designed to produce steam in order to improve ironing have a semi-closed cavity formed on the upper face of the sole plate and into which water is dripped from an on-board reservoir to produce steam which is then allowed to escape onto the clothes by means of a series of apertures formed in the sole plate. These are commonly known as vented steam irons. They are relatively simple and inexpensive to implement which has made them very popular. However, the steam produced is at very low pressure (essentially ambient pressure) and cannot be produced very quickly, making it relatively ineffective.

At the other end of the market, are professional or semi-professional steam ironing systems in which high pressure steam (e.g. of the order of 3 to 5 bar) is continuously produced in a static base station incorporating a large water reservoir which can then be fed, on demand, to the user's hand-held unit by means of an umbilical cord.

These are commonly known as pressurized steam generator irons. They deliver a very high performance but are very expensive and tend to account therefore only for a very small proportion of the market.

More recently there have been proposals, some of which have been commercialized, which seek to bridge the gap between the two extremes outlined above, although these have tended to carry their own drawbacks. For example, it has been proposed to provide a boiler in a base unit, separate from the iron, which is fed by pumping water into it from a reservoir in the base station. The main disadvantage with these arrangements, commonly known as instantaneous steam generator irons, is that there is in fact a significant time lag (of the order of 10 seconds) between the user pressing a button to demand steam and the steam actually being produced and conveyed to the iron. This significantly limits user acceptance, even though higher steam flow rates than vented steam irons can be achieved when the steam is eventually delivered.

It is an aim of the present invention to provide an improved arrangement for generating steam on demand which can be used in steam irons, and also in other devices employing steam, such as steam cleaners, wallpaper strippers, other steam generating appliances, etc.

SUMMARY OF THE DISCLOSURE

When viewed from a first aspect the invention provides a pressurized boiler for a steam generator appliance comprising an evaporation chamber, an electric heater in good thermal contact with a wall of the evaporation chamber, a water inlet arranged in a cover of the evaporation chamber separate from said wall, and a pump in fluid communication with the water inlet arranged to supply water to the evaporation chamber through the water inlet.

Having the water inlet in a separate cover affords a number of advantages. Primarily the water inlet being in a separate component (the cover) isolates the cooler water supply from the hotter heated walls of the evaporation chamber thus avoiding large temperature gradients in the walls of the evaporation chamber, e.g. compared to if the water inlet was supplied through a heated wall of the evaporation chamber. By avoiding large temperature gradients, premature failure of the boiler through cracking of the heated walls may be avoided. In a preferred set of embodiments the boiler comprises heat resistant sealing means, e.g. a heat resistant sealing gasket or O-ring, between the heated wall and the cover of the evaporation chamber.

As well as acting to thermally isolate the water inlet from the heated walls of the evaporation chamber, providing the water inlet in the cover of the evaporation chamber physically spaces the water inlet from the heated walls. This spacing provides an internal volume within the evaporation chamber between the water inlet and the heated wall in which scale can build up without blocking the water inlet, e.g. as could happen if the water inlet were provided in the heated wall of the evaporation chamber—e.g. at the bottom of the chamber. In a preferred set of embodiments the water inlet is spaced by at least 5 mm from the heated wall of the evaporation chamber, preferably at least 10 mm, more preferably at least 15 mm, e.g. at least 20 mm. Expressed alternatively, the water inlet is spaced by at least 50% of the maximum dimension of the chamber from the heated part of the chamber wall.

The Applicant has found, counter-intuitively, that at least some steam generators constructed in accordance with the invention can operate efficiently even when a relatively large amount of scale is present within the evaporation chamber, because of the volume in which scale can safely build up, provided by the spacing of the water inlet from the walls of the evaporation chamber. This is convenient in giving a long operating life without the need to provide user access to the interior of the pressurized boiler.

The cover could be attached to the wall(s) of the evaporation chamber by any suitable means, e.g. screws, bolts, clamps, welding, but in one set of embodiments the cover is attached to wall(s) of the evaporation chamber by peening, e.g. over the external surface of the evaporation chamber wall(s) and cover to seal the cover in place. This can create an improved seal between the cover and the wall(s) of the evaporation chamber because there is no need to provide additional components, e.g. screws, that may be prone to failure through continued use of the boiler and which would eventually result in the steam pressure generated in the evaporation chamber being sufficient to force the cover open.

In one set of embodiments the heated wall(s) and the cover of the evaporation chamber each comprise a sealing surface between which the heat resistant sealing means is positioned. Preferably the distance between the sealing surface of the heated wall(s) and the sealing surface of the cover is less than the thickness of the sealing means, so that the sealing means is held under compression. This improves the resistance of the sealing means against the steam pressure generated inside the evaporation chamber. Therefore preferably the sealing means comprises a compressible material, e.g. rubber, silicone.

The sealing surface of the heated wall(s) is generally parallel to the sealing surface of the cover, with the sealing means sandwiched between. The sealing surfaces could be substantially perpendicular to the direction in which the cover is placed on the evaporation chamber, e.g. in the general horizontal plane of the cover if the cover is flat and covering an opening in the top of the evaporation chamber. However it has been found that sealing in this direction is not effective after prolonged use of the boiler. This is because repeated thermal cycling of the boiler eventually causes slight relative movements between the heated walls and the cover. Therefore if the sealing means is in compression between the two sealing surfaces, thereby exerting a force in the direction in which the cover is opened, over time the steam pressure generated during operation acts to force the cover open and allows steam to escape past the sealing means.

In one set of embodiments the sealing surfaces are substantially parallel to the direction in which the cover is placed on the evaporation chamber. This has the effect that the direction in which the sealing force is being exerted between the sealing means and the sealing surfaces, is perpendicular to the direction in which the cover is opened, so this force is not acting to open the cover. Furthermore, the sealing surfaces and/or the sealing means can be arranged such that there is some tolerance in the fit between the respective parts which allows some degree of movement of the cover relative to the rest of the evaporation chamber without compromising the seal. Also, if the cover is being worked loose from repeated operation, the steam pressure acts to force the sealing means into the path through which steam could escape, thereby preventing steam for escaping and retaining the cover on the boiler, resulting in the life of the boiler, i.e. the number of operational cycles or hours before steam starts to escape past the sealing means being prolonged. The feature of the sealing means being arranged between the sealing surfaces in this direction has been found to result in a significant increase in the life of the boiler.

The water inlet could be provided at any point in the cover of the evaporation chamber, but in a preferred set of embodiments the water inlet is provided in the center of the cover. In this set of embodiments the water can therefore be made to fall from the water inlet onto a central point on the wall of the evaporation chamber opposite the inlet so that it is evenly distributed across the heated wall which assists the efficient and rapid generation of steam.

In a preferred set of embodiments the water inlet comprises a nozzle which projects away from the cover and into the evaporation chamber. This helps to separate the water inlet from the steam outlet, where this is also conveniently provided in the cover of the evaporation chamber, and therefore helps to prevent the steam from undesirably entraining drops of water from the water inlet into the outlet steam flow.

This is novel and inventive in its own right and therefore when viewed from a further aspect the invention provides a pressurized boiler for a steam generator appliance comprising an evaporation chamber, an electric heater in good thermal contact with one or more walls of the evaporation chamber, a nozzle which projects into the evaporation chamber, and a pump in fluid communication with the nozzle arranged to supply water to the evaporation chamber through the nozzle.

In this aspect of the invention the nozzle may or may not be provided in a separate cover as recited in the first aspect of the invention, e.g. it could alternatively project from a wall or the base of the evaporation chamber. It will be appreciated that this arrangement also helps to separate the water inlet from the heated walls of the evaporation chamber where scale builds up, and therefore prevents scale blocking the water inlet, as has been discussed above.

In one set of embodiments of either of the foregoing aspects of the invention, the wall of the evaporation chamber comprises a protuberance, preferably located opposite the water inlet, e.g. at the center of the base in a preferred set of embodiments. The protuberance can prevent water collecting in a pool at the bottom of the evaporation chamber and therefore water from the water inlet falling into a standing pool of water. Instead the water falls onto the protuberance, which because of the spacing of the water inlet from the heated wall of the evaporation chamber, results in an impact causing the water to break up into smaller droplets that are projected onto the internal surface of the evaporation chamber, thereby aiding rapid evaporation of the water and hence efficient steam generation. This contrasts, for example, with a water inlet provided at the bottom of an evaporation chamber, as there may then be a tendency for water to collect at the bottom of the evaporation chamber and not be spread over the heated surface.

This is novel and inventive in its own right and therefore when viewed from a further aspect the invention provides a pressurized boiler for a steam generator appliance comprising an electric heater, an evaporation chamber in good thermal contact with the electric heater, a water inlet, wherein a wall of the evaporation chamber comprises a protuberance located opposite the water inlet.

The protuberance could take many different forms, e.g. a simple conical, frusto-conical or convex dome—or a more complex shape.

Preferably the boiler is provided with a pump for delivering water to the water inlet.

In a preferred set of embodiments of any aspect of the invention the boiler is provided in a portable appliance such as a steam iron, steam cleaner, wallpaper stripper or other hand-held steam generating appliance. Therefore the invention extends to a steam generator appliance comprising a boiler as set out in all aspects of the invention.

In a preferred set of embodiments the boiler comprises a valve to control the inlet of water through the water inlet into the evaporation chamber. This enables the amount of water admitted into the evaporation chamber to be regulated so that steam can be generated efficiently, i.e. the water flow rate into the evaporation chamber can be optimized for maximum steam generation. For example, if too much water is admitted at once the evaporation chamber will be cooled, preventing steam from being produced rapidly. The provision of a valve also enables water to be admitted after the electric heater is first energized, allowing the evaporation chamber to be preheated so that when water is admitted, steam is rapidly produced.

Although the boiler will typically be thermostatically controlled, it is preferably arranged such that it is allowed to reach a higher operating temperature when there is no water flow, e.g. when the pump is off or the aforementioned valve is closed, than when water is flowing. This means that the boiler can store additional thermal energy in its thermal mass, further reducing the time to produce the first shot of steam after the valve is opened because the water can then be heated more rapidly.

The water for supplying the boiler may be provided in a number of ways. In a set of preferred embodiments the boiler is provided in a portable appliance also including a reservoir. In a set of embodiments, the reservoir is pressurized. This could for example be achieved by means of a compressed air chamber or the reservoir could be elastically charged.

Where a pump is provided, there may be provided means to delay operation of the pump until the boiler has reached a predetermined operating temperature. A temperature sensitive control means may be arranged to provide an electrical connection to the pump only when it is detected that the operating temperature has been reached. Alternatively a timer could be programmed to delay the operation of the pump until such time that the boiler is expected to have heated up. It is preferred that the pump and electric heater of the boiler are connected electrically in parallel so that they may be controlled by a common on/off switch. This allows for simple "one button" operation of the appliance, while also ensuring that the boiler is hot enough when water is pumped into it that steam generation starts rapidly. Advantageously the start-up time may be reduced.

The evaporation chamber could take a variety of forms and shapes, e.g. tubular, cuboid, conical, part-spherical, obloid, pill-box shaped, etc. In a preferred set of embodiments the evaporation chamber has a portion converging away from the inlet. It could, for example, have a U-shaped cross section with vertical or substantially vertical side walls and a concave base (ignoring any protuberance on the base)—i.e. be broadly torpedo shaped. A torpedo shaped evaporation chamber provides a large surface area from which water can be evaporated. It also provides an evaporation chamber with a large volume (for a given surface area) so that it can operate efficiently even with a large build up of scale.

The heated surface bounding the evaporation chamber (hereinafter referred to as "the evaporation surface") is preferably provided with one or more protrusions or recesses to increase the surface area thereof. In a set of preferred embodiments, the surface area of the evaporation surface is more than 10% greater than the area of a smooth surface having the dimensions of the mean surface height, preferably more than 50% greater, more preferably more than 75% greater, more preferably more than 100% greater.

There are many different ways in which the evaporation surface area could be increased e.g. ridges, ribs, dimples, grooves, bumps, etc. In a preferred set of embodiments the evaporation surface comprises a plurality of parallel, e.g. vertically extending, ribs. Vertical features can prevent water from collecting on the evaporation surface, e.g. compared to features which run horizontally. The vertically extending ribs could also extend across the base of the evaporation chamber, e.g. extending radially outward from the center of the base and then vertically up the walls. As will be appreciated, vertical features are more easily provided in the manufacturing procedure in the embodiments with an evaporation chamber with substantially vertical side walls.

The vertical ribs could comprise alternating convex and concave features, and in a preferred set of embodiments the radius of curvature of these features is between 1 and 3 mm. Preferably there are 24 or fewer vertical ribs arranged around the evaporation chamber, e.g. 22. This arrangement of alternating convex and concave features helps to maximize the area of the evaporation surface whilst giving good performance and manufacturability.

In a preferred set of embodiments the evaporation chamber is die cast, preferably from aluminum. Aluminum is suitable for die casting, is relatively cheap, has a relatively high specific heat capacity and is suitable for treating with a hydrophilic coating. The electric heater could surround the evaporation chamber, e.g. be attached to its outer surface. However, in a preferred set of embodiments the electric heater is embedded in the walls of the evaporation chamber, e.g. by die casting the evaporation chamber around the electric heater. This maximizes the heat transfer from the electric heater to the evaporation surface and minimizes thermal losses.

The electric heater could comprise any suitable heater, e.g. a thick film heating element attached to the outer surface of the evaporation chamber, but in a preferred set of embodiments the electric heater comprises a sheathed heating element. Preferably the sheathed heating element is embedded in the walls of the die cast evaporation chamber as mentioned above. The sheathed heating element could follow any suitable path around the walls of the evaporation chamber, but in a preferred set of embodiments the sheathed heating element follows a spiral or helical path.

In a preferred set of embodiments, the mass of the boiler is less than 0.6 kg and is arranged such that during operation the temperature gradient between the electric heater and the heated surface of the evaporation chamber is less than 60° C./mm. Such an arrangement has been found to give a boiler which gives a desirably fast start-up time but without the risk, appreciated by the Applicant, of premature cracking of the boiler which might occur if the mass of the boiler were simply reduced to give a low start-up time. In fact in some preferred embodiments of the invention the mass of the boiler is greater than the skilled person would otherwise have specified in order to meet the thermal gradient criterion specified above to avoid cracking. Having a boiler with a relatively large mass is also advantageous when the boiler is provided in a cordless appliance as this provides a prolonged period over which steam can be generated owing to the relatively large thermal capacity of the boiler.

Such an arrangement is novel and inventive in its own right and thus when viewed from a further aspect the invention provides a pressurized boiler for a steam generator appliance comprising an electric heater, an evaporation chamber in good thermal contact with the electric heater, wherein the evaporation chamber has a mass less than 0.6 kg, and during operation is arranged such that the temperature gradient between the electric heater and the heated surface of the evaporation chamber is less than 60° C./mm.

In a typical embodiment, the temperature of the wetted evaporation chamber surface during operation is 120° C. and the temperature at the surface of the heating element is 270° C. The Applicant has found that if the temperature gradient is less than 60° C./mm, preferably less than 50° C./mm, preferably less than 40° C./mm, premature cracking will not occur. It will be appreciated that the arrangement described in the first aspect of the invention with the water inlet provided in the cover of the evaporation chamber, helps to reduce this temperature gradient as it isolates the cooler water supply from the hotter heating element and heated walls of the evaporation chamber, as has been discussed above.

In a preferred set of embodiments, the distance between the heating element and the evaporation surface is greater than 3 mm, preferably greater than 4 mm.

The temperature gradient across the wall of the evaporation chamber is also affected by the shape of the chamber and configuration of the heating element, e.g. the separation between adjacent loops of a spiral sheathed heating element. If the loops are too close together, then this will result in too high a temperature gradient owing to the proximity of the heat energy sources.

It will appreciated that the previously recited features for the previous aspects of the invention are not exclusive to any particular aspect and can be incorporated in any combination with any aspect of the invention.

In an exemplary set of embodiments the normal operating temperature is greater than 160° C. Preferably the evaporation surface is hydrophilic, at least at its normal operating temperature. This might be a natural characteristic of the material used for the evaporation surface, it might be achieved or enhanced by a suitable surface treatment and/or it might be achieved or enhanced by a suitable heat resistant coating material. Where the evaporation surface is made hydrophilic by a surface treatment or coating the treated or coated surface should be hydrophilic at a temperature at which the Leidenfrost effect would otherwise occur on the untreated or uncoated surface.

The evaporation chamber may of course have more than one evaporation surface. This might be the case as a result of the distribution of the heating element, the provision of multiple heating elements, or simply by the close thermal connection between a surface which is directly heated and another surface.

In a set of preferred embodiments the boiler is configured to produce pressurized heated steam. In some preferred embodiments the boiler has a temperature of between 100 and 500° C., more preferably between 105 and 380° C. Preferably the internal steam pressure generated within the boiler should not be greater than that of the water pressure entering it, else water will be prevented from entering the device, resulting in a subsequent drop in steam flow rate and unwanted fluctuation in steam output. Steam may simply be allowed to leave the boiler once it has passed through the evaporation chamber. In a preferred set of embodiments the steam outlet is provided in separate cover—e.g. on an upper part of the evaporation chamber, which in one set of embodiments will be adjacent the water inlet. Providing the steam outlet in an upper part of the evaporation chamber helps to prevent scale particles clogging the steam outlet.

However, in a set of preferred embodiments the boiler comprises means for collecting the steam. This allows it, for example, to be channeled into one or more pipes for delivering it to the steam outlet(s) of an appliance on which the boiler is provided. The means for collecting steam may comprise means for trapping unevaporated droplets of water. For example this might be a protruding outlet tube encouraging steam channeled by the walls of the chamber to undergo a change of direction leading to expulsion of entrained droplets.

In one set of embodiments the boiler is divided into the evaporation chamber and a steam collection space. In a set of embodiments the boiler is divided by an intermediate member provided in the evaporation chamber of the boiler. Preferably the intermediate member provides one of the surfaces defining the evaporation chamber. In one set of embodiments the intermediate member comprises a mesh. This mesh retains scale particles within the evaporation chamber, i.e. prevents them from passing into the steam collection space and into the steam outlet where they could create a blockage, and it also reduces the risk of water droplets, e.g. entrained from the water inlet into the steam, from passing into the steam outlet. Water droplets in the steam outlet are to be avoided because they may form steam bubbles which can become trapped and then cause spitting, or generally drops of water will pass into the steam outlet, which is undesired when dry steam is preferred.

In the embodiments in which an intermediate member is provided to separate the evaporation chamber from the steam collection space, preferably the water inlet projects through the intermediate member into the evaporation chamber. It will be appreciated that this arrangement is particularly suited to the aspect and embodiments of the invention in which the water inlet comprises a nozzle which projects into the evaporation chamber. As well as providing an unrestricted path for water entering the evaporation chamber, i.e. the water not having to pass through the intermediate member, having the water inlet passing through the steam collection space preheats the water before it enters the evaporation chamber.

A boiler in accordance with the aspect of the invention set out above may usefully be used for the continuous generation of steam. However, it is particularly beneficial for appliances where steam is required "on demand". An important factor in achieving this effect is to supply water to the boiler under pressure and thus a particularly preferred set of embodiments has a boiler of the kind described above, or indeed one which only has some of the features set out in an appliance comprising means for supplying pressurized water to the water inlet of the boiler. As previously mentioned, such an appliance could, for example comprise an electric iron, a steam cleaner, wallpaper stripper or any other steam generating appliance. The means for pressurizing water could be any suitable means such as an elastically charged store or a pressurized reservoir upstream of the evaporation chamber. The pressure of the water supply is preferably greater than 0.5 bar, e.g. more than 1 bar and might be up to 3 bar or more.

Where the boiler is to be used to produce steam "on demand" it is beneficial, in order to minimize the initial delay between filling it with water and producing steam, that when it does not contain water, it is allowed to increase in temperature and therefore store thermal energy which can be used to heat the initial charge of water to boiling as rapidly as possible. In a set of preferred embodiments, the useable energy which the boiler is adapted to store, that is the amount of heat energy available to generate steam, is more than 20 kilojoules, more preferably greater than 35 kilojoules and more preferably greater than 50 kilojoules.

BRIEF DESCRIPTION OF THE DRAWINGS

Certain preferred embodiments of the invention will now be described, by way of example only, with reference to the accompanying drawings in which.

DETAILED DESCRIPTION OF THE INVENTION

Figure 1:
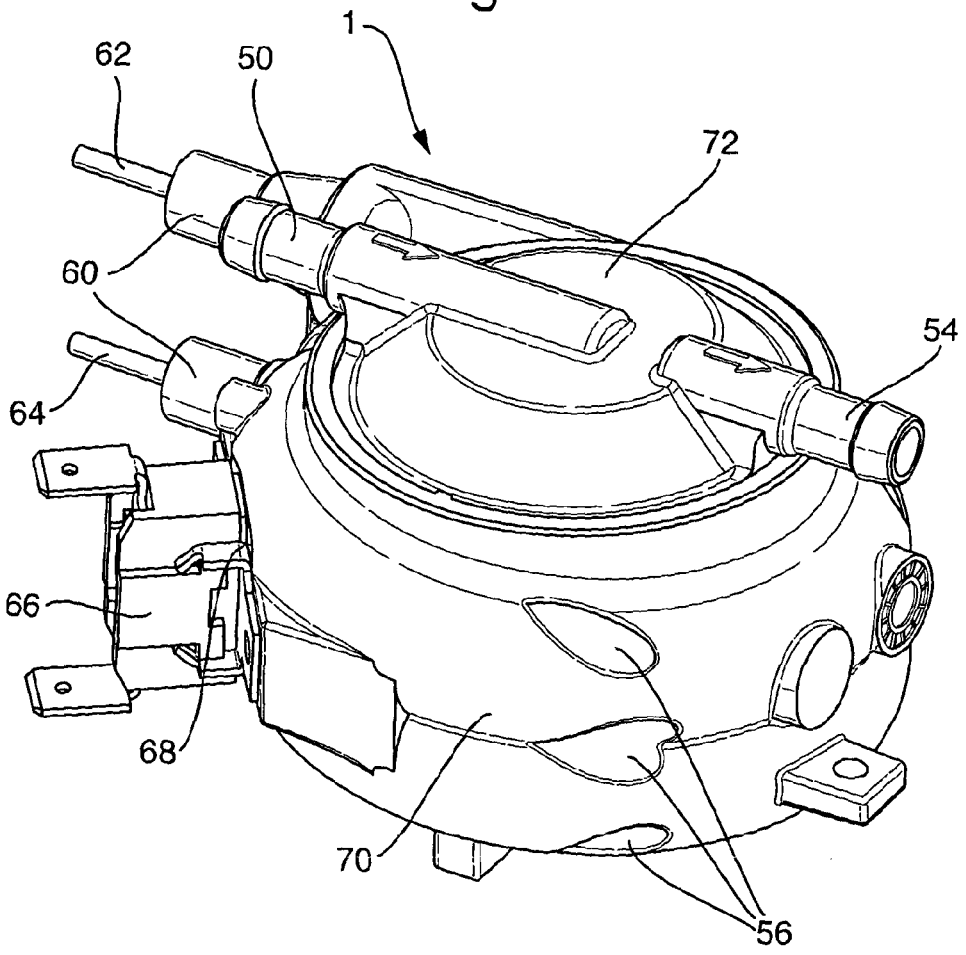
FIG. 1 is a perspective view of a boiler in accordance with an embodiment of the invention.

FIG. 1 shows the external appearance of a boiler 1 for a steam generator embodying the invention comprising a lower body member 70 which is of die-cast aluminum and an upper cover member 72, also of die-cast aluminum.

In the upper left hand region of the boiler 1 there can be seen a water inlet 50 and the two ends of a sheathed electrical resistance heating element 60. Projecting electrical terminals 62, 64 (known in the art as cold tails pins) are provided to enable electrical connection to the element 60. A high temperature regulator 66 is provided against a flange 68 on the lower body member 70 of the boiler. Also on the lower body member 70 of the boiler can be seen a number of apertures 56 which extend through the wall of the lower body member 70 to expose the sheathed heating element 60. The purpose of these apertures 56 is to allow positioning of the heating element 60 in the die-cast tool when die-casting the lower body member 70. A steam outlet 54 is visible in the top right hand part of FIG. 1.

Figure 2:
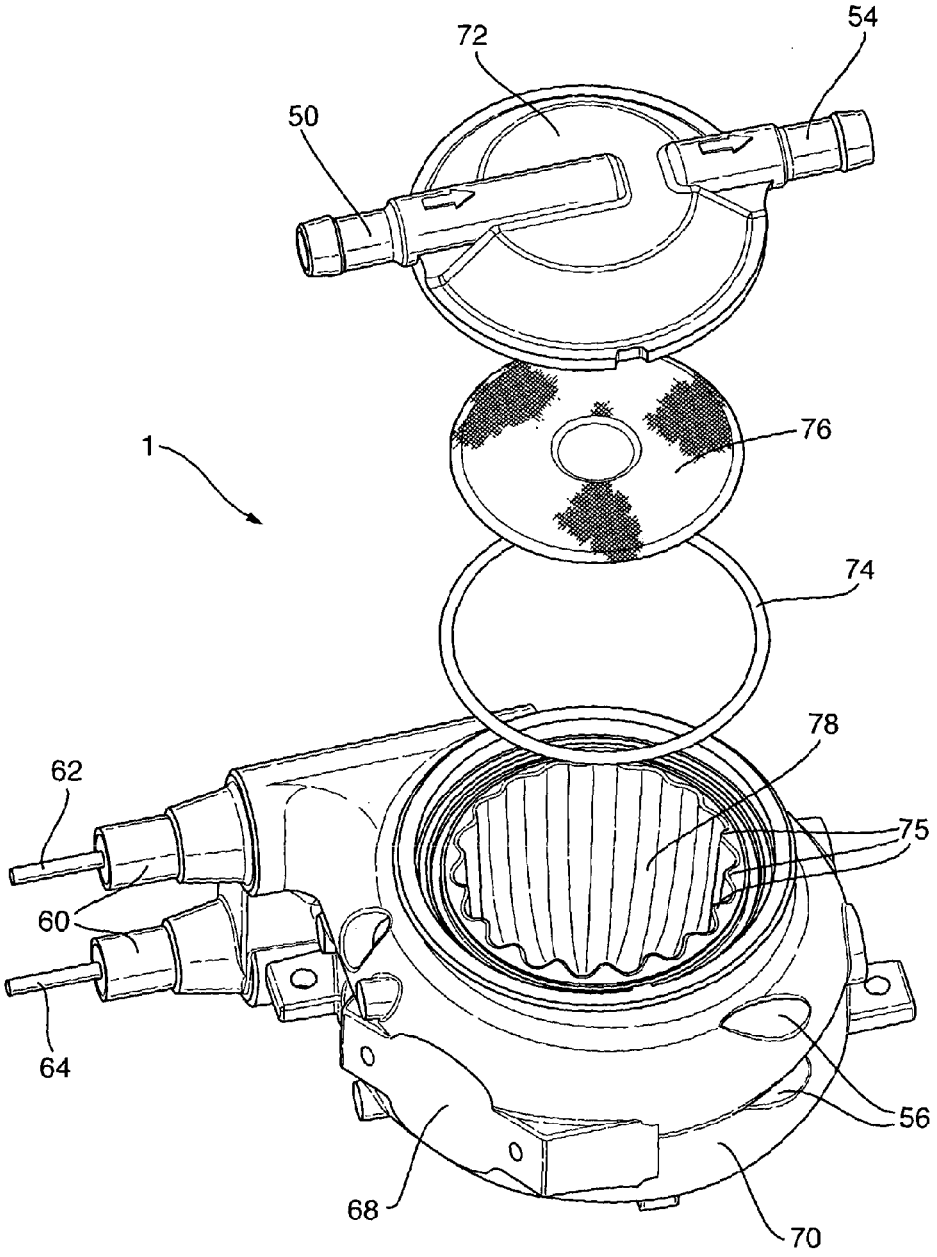
FIG. 2 is an exploded view of the boiler of FIG. 1.

With particular reference now to FIG. 2 (in which the high temperature regulator 66 has been removed for clarity), it can be seen that the main section of the boiler is made up of four main parts: the lower body member 70 and upper body (cover) member 72, both of which are made of die-cast aluminum but could equally be made of another non-ferrous metal or other suitable material; a disc shaped mesh layer 76, e.g. of stainless steel, and a heat-resistant seal 74. When assembled, the upper and lower body members 70, 72 are clamped together by suitable means and this retains the disc shaped mesh layer 76 and heat-resistant seal 74 between them.

It will be seen that inside, the lower body member 70 defines a generally torpedo shaped evaporation chamber 78. The inner wall of this evaporation chamber 78 is formed with a series of vertical ribs 75, and a small protuberance 58 in the center of the base (see FIG. 3), the purposes of which will be explained later.

Figure 3:
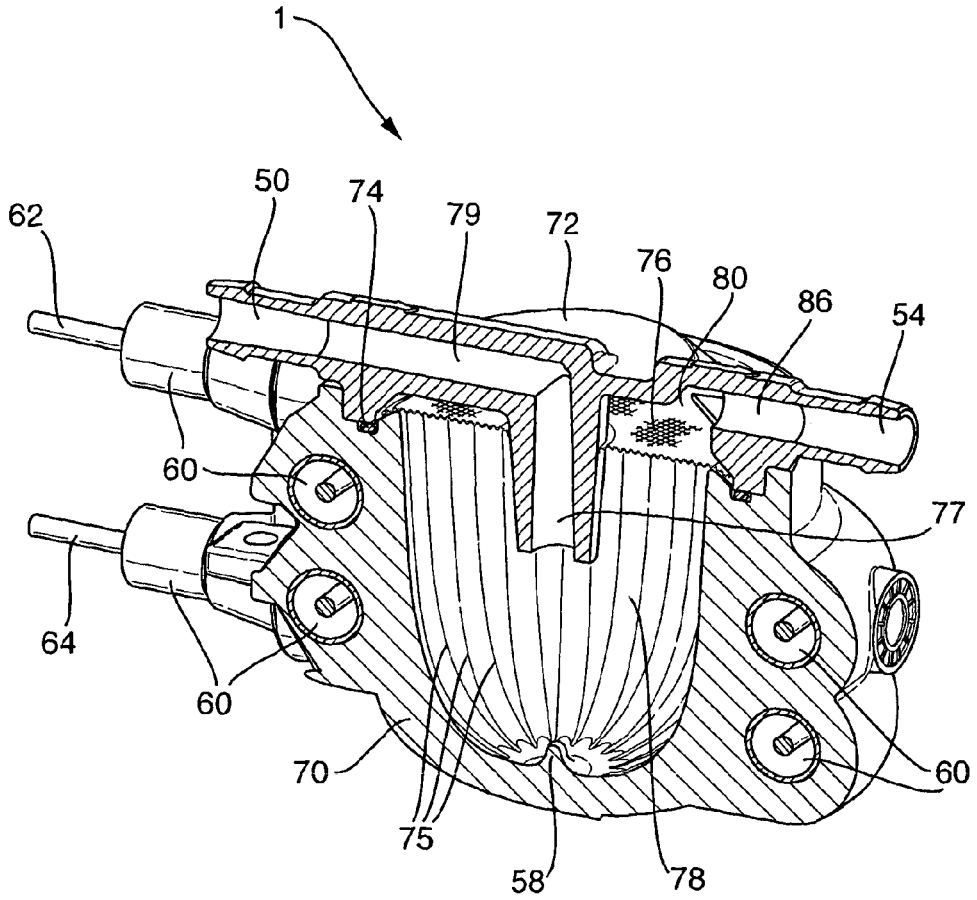
FIG. 3 is a vertical cross section through the boiler of FIGS. 1 and 2.

FIG. 3 shows a cross-section through the assembled boiler 1. This Figure shows that the lower body member 70 has much thicker walls than the cover member 72 since they accommodate an embedded heating element 60. This is cast into the lower body member 70 during manufacture. The element is approximately helical so that it wraps around the conical cavity formed by the lower body member 70. This ensures an even heat distribution across the lower wall of the evaporation chamber 78.

In the upper portion of the evaporation chamber 78 is the disc shaped mesh layer 76 which separates the evaporation chamber 78 below the mesh layer 76 from a steam collection space 80 above the mesh layer 76. A downwardly projecting spout 77, which projects through the center of the mesh layer 76, fluidly communicates with the water inlet 50 via a conduit 79. At the top of the steam collection space 80 there is the steam outlet 54 formed by a passageway 86 through the cover member 72.

The internal heat transfer surfaces—that is the walls of the chamber 78—may be coated with a functional heat resilient surface coating that enhances the transfer of heat into the water. Such a coating can improve the speed of heat absorbed by the water particularly at operating temperatures above 160° C. and below 380° C. The coating can be applied in a single coat. To ensure its durability it may however be necessary subsequently to cure it at an elevated temperature. The method of application need not be complicated and can be accomplished without sophisticated equipment—e.g. via spray, brush, roller or any other suitable method. However other methods can be employed such as electrolytic, electrostatic, plasma, thermal spray, vacuum deposition, spin coated, sol gel process, evaporation and others.

The functional coating may provide a hydrophilic surface and substantially increase the available heat transfer surface area of the evaporation space by giving the coated surfaces thereof a microstructure. A micro-surface and partially subsurface structure is imparted by the coating as it creates a surface matrix and micro-textured surface. Additionally the coating is thermally shock resilient, adheres strongly to the internal surfaces and preferably inhibits corrosion.

It will be seen that the internal configuration of the boiler has heat transfer surfaces that are configured to operate at different scales through use e.g. of the functional coating which operates to improve thermal transfer efficiencies at dimensions between the nano and micro scales. The surface to which the coating is applied is configured to impart a texture to the coating operating between a micro and macro scales.

The vertically ribbed surface structure 75 on the other hand operates to enhance heat transfer at a macro scale. Therefore the evaporation space operates as a complex heat transfer surface/matrix with additional complex heat transfer surface/matrix interactions at the micro and nano scale provided by the functional coating.

Figure 4A:
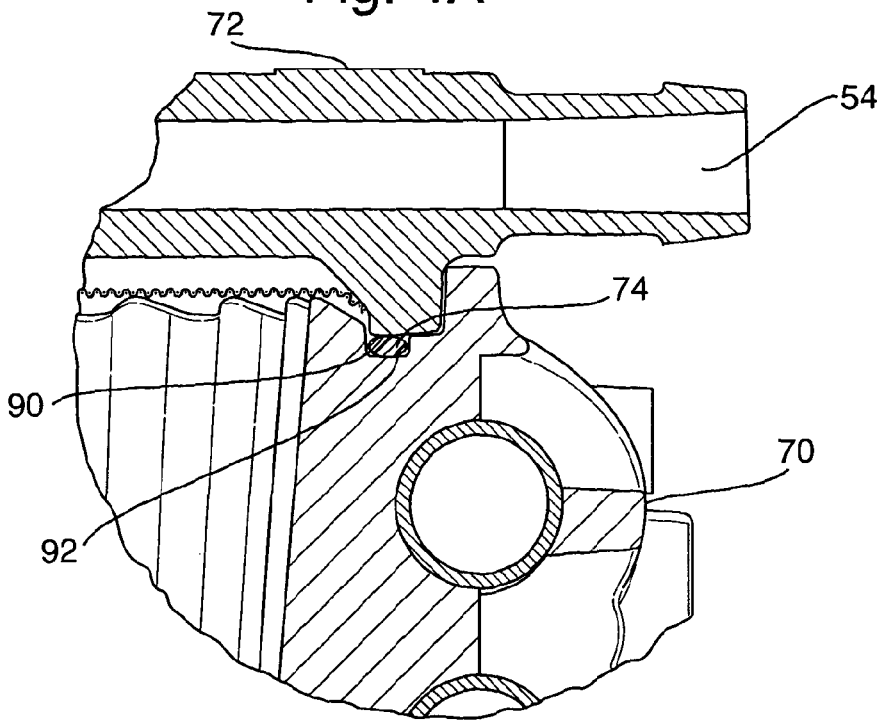
FIGS. 4*a* and 4*b* are enlarged portions of the sealing region of FIG. 3 for two different embodiments of the invention.
Figure 4B:
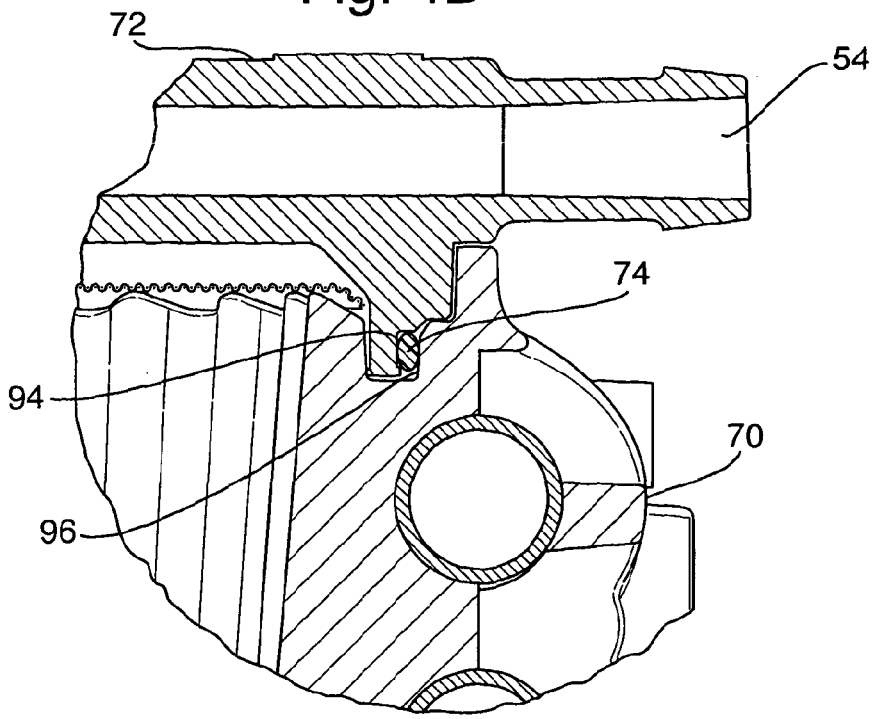

The sealing region between the lower and upper body members 70,72 for two different embodiments is shown in FIGS. 4*a* and 4*b*, which corresponds to an enlarged view of the upper right hand portion of FIG. 3, around the steam outlet 54. In FIG. 4*a* the heat-resistant seal 74 is held compressed between a horizontal sealing surface 90 on the upper body member 72 and a parallel horizontal sealing surface 92 on the lower body member 70 to create a tight seal between the lower and upper body members 70,72. In FIG. 4*b* the heat-resistant seal 74 is held compressed between a vertical sealing surface 94 on the upper body member 72 and a parallel vertical sealing surface 96 on the lower body member 70.

Operation of the steam generator will now be described with reference to the Figures. Electrical power is supplied to the sheathed resistance heating element 60 which is embedded in the lower body member 70 of the boiler. This is controlled by a separate high temperature regulator 66 which allows the boiler to reach a high temperature e.g. between 160° C. and 380° C. Although not shown, one or more indicator lights or other form of indication might be provided to a user to indicate that the boiler has reached its predetermined temperature.

Water is pumped from a reservoir by a pump (neither of which is shown), optionally via a valve (also not shown). The water first enters the boiler 1 by means of the inlet 50 and passes through a conduit 79 in the cover member 72. As the water passes through this conduit 79, it is preheated so that when it enters the evaporation chamber, its temperature is raised significantly above ambient (but below boiling). The water enters the evaporation chamber 78 by means of spout 77 which projects through the center of the mesh layer 76 and impacts against the protuberance 58 with a pressure greater than if it merely had dripped under gravity. The water therefore rebounds off the protuberance 58 in small droplets onto the heated walls of the evaporation chamber 78. This impact spreads the water across a large surface area (which is further enhanced by the vertical ribs on the walls) which allows a relatively large quantity of water to be evaporated into steam from a relatively small boiler volume.

The spacing of the water inlet spout 77 from the base of the evaporation chamber 78, combined with the near vertical walls provide a relatively large volume in which scale can build up without blocking the water inlet spout 77 or preventing efficient steam generation in the evaporation chamber 78.

The steam which is produced escapes from the evaporation chamber 78 through the mesh layer 76 clamped between the upper and lower members 70, 72 of the boiler and into the steam collection space 80. The mesh layer 76 helps to trap any small remaining droplets of water entrained in the steam as well as any scale particles. Any droplets of water trapped by the mesh layer 76 are evaporated. The pressure of this steam forces it out of the passageway 86 in the top of the steam collection space 80. The steam exiting the evaporation chamber 78 is pressurized. The steam passes through the passageway 86 to the steam outlet 54 and from there into the appliance (not shown) to be used as required. The rate at which steam is generated can be varied by altering the flow rate of water into the evaporation chamber 78, e.g. by controlling a valve (not shown) on the water inlet 50.

In a particular example of the steam generator described above, the lower member 70 had a mass of 0.516 Kg and was made from aluminum having a specific heat capacity of 0.91 J/(g-K). The heating element 60 had a power of 1800 W and its operating temperature is 270° C. The minimum thickness of the evaporation chamber wall 78 between the element 60 and the nearest valley between ribs 75 was 3 mm. The temperature of the wetted evaporation surface 78 was 120° C. The thermal gradient across the surface was therefore (270-120° C.)/3 mm=50° C./mm. The start-up time for the heater was approximately 60 seconds. No premature cracking of the boiler was observed through accelerated lifetime testing.

It will be appreciated that in the sealing arrangement in FIG. 4*a*, internal steam pressure in the chamber which tends to separate the upper body member 72 from the lower body member 70 will tend to reduce the compressive force on the seal 74 and thereby increase the risk of leakage. However in the arrangement shown in FIG. 4*b*, vertical movement of the upper body member 72 relative to the lower body member 70 will not reduce the compressive force on the seal 74. Indeed any build up of steam pressure passing between the upper and lower body members serves to further compress and hence maintain the seal. This arrangement has therefore been found to have a significantly longer life before leakage occurs.

Thus it will be seen by those skilled in the art that the embodiment of various aspects of the invention described above provides an extremely effective steam generator boiler which offers the performance of a high steam pressure but which can be produced at a significantly lower cost than traditional pressurized steam generators—e.g. as found in professional ironing systems.

Whilst the invention has been described in terms of one specific embodiment, many aspects and features of the invention might be applied to many different types of steam generators, in appliances such as irons, wallpaper strippers and other hand-held steam generating appliances. Features mentioned in connection with the embodiments described in detail above or indeed with any other embodiments mentioned herein may be applied equally to any other embodiment and the applicant specifically envisages such combinations of features. Any feature of the invention should therefore be considered as independently applicable and not limited in its application to this specific embodiment in which it is mentioned, except where otherwise indicated.

What is claimed is:

1. A pressurized boiler for a steam generator appliance comprising an evaporation chamber, an electric heater in good thermal contact with a wall of the evaporation chamber, a water inlet arranged in a cover of the evaporation chamber separate from said wall, wherein the wall and the cover of the evaporation chamber each comprise respective first and second sealing surfaces, said first and second sealing surfaces being substantially parallel to a direction in which the cover is placed on the evaporation chamber and further comprising a heat resistant seal between the first and second sealing surfaces and a pump in fluid communication with the water inlet arranged to supply water to the evaporation chamber through the water inlet.

2. The pressurized boiler as claimed in claim 1, wherein the water inlet is spaced by at least 50% of the maximum dimension of the chamber from the heated part of the chamber wall.

3. The pressurized boiler as claimed in claim 1, wherein the water inlet comprises a nozzle which projects away from the cover and into the evaporation chamber.

4. The pressurized boiler as claimed in claim 1, comprising a steam outlet arranged in the cover of the evaporation chamber.

5. The pressurized boiler as claimed in claim 1, arranged such that the boiler is allowed to reach a higher operating temperature when there is no water flow.

6. The pressurized boiler as claimed in claim 1, wherein the heated surface bounding the evaporation chamber is provided with one or more protrusions or recesses to increase the surface area thereof.

7. The pressurized boiler as claimed in claim 6, wherein the evaporation surface comprises a plurality of parallel ribs.

8. The pressurized boiler as claimed in claim 1, wherein the electric heater is embedded in the walls of the evaporation chamber.

9. The pressurized boiler as claimed in claim 1, wherein the mass of the boiler is less than 0.6 kg, and wherein the boiler is arranged such that during operation the temperature gradient between the electric heater and the heated surface of the evaporation chamber is less than 60° C./mm.

10. The pressurized boiler as claimed in claim 1, wherein the heated surface bounding the evaporation chamber is hydrophilic.

11. The pressurized boiler as claimed in claim 1, wherein the boiler is arranged in operation to have a temperature of between 100 and 500° C.

12. The pressurized boiler as claimed in claim 1, wherein the boiler is divided into the evaporation chamber and a steam collection space by an intermediate member provided in the evaporation chamber of the boiler.

13. The pressurized boiler as claimed in claim 12, wherein the water inlet or nozzle projects through the intermediate member into the evaporation chamber.

14. A steam generator appliance comprising a pressurized boiler as claimed in claim 1.

15. The steam generator appliance as claimed in claim 14, comprising a pressurized reservoir.

16. The pressurized boiler as claimed in claim 11, wherein the boiler is arranged in operation to have a temperature of between 105 and 380° C.

* * * * *